United States Patent [19]

Moore

[11] 4,427,061

[45] Jan. 24, 1984

[54] UNIVERSAL DRIFT AND RETRIEVER

[76] Inventor: Richard J. Moore, 104 Bellehomme, Lafayette, La. 70506

[21] Appl. No.: 303,587

[22] Filed: Sep. 18, 1981

[51] Int. Cl.[3] ..... E21B 47/08; E21B 23/00

[52] U.S. Cl. ..... 166/113; 166/178; 33/178 F

[58] Field of Search ..... 166/113, 155, 170, 178, 166/250; 175/293, 294, 299; 33/178 B, 178 F

[56] References Cited

U.S. PATENT DOCUMENTS

| | | | |
|---|---|---|---|
| 2,715,281 | 8/1955 | Black | 33/178 B |
| 3,052,302 | 9/1962 | Lagucki | 166/170 |
| 3,276,520 | 10/1966 | Arnold . | |
| 3,394,763 | 7/1968 | Page, Jr. . | |
| 3,409,095 | 11/1968 | Bardwell | 175/299 |
| 3,456,727 | 7/1969 | Nettles . | |
| 4,007,784 | 2/1977 | Watson et al. | 166/170 |
| 4,227,309 | 10/1980 | Jones | 33/178 F |

FOREIGN PATENT DOCUMENTS

| | | | |
|---|---|---|---|
| 578429 | 10/1977 | U.S.S.R. | 175/299 |

*Primary Examiner*—Stephen J. Novosad
*Assistant Examiner*—William P. Neader
*Attorney, Agent, or Firm*—Saidman, Sterne & Kessler

[57] ABSTRACT

A device or drift for gauging the inside diameter of pipe comprising an elongated body having a cylindrical outer surface adapted to receive a set of bushings having an outside diameter consistent with the inside diameter of the pipe to be gauged. A plurality of bushing sets are available for use on the body to gauge various weights and sizes of pipe. The body is formed of a hard, heavy material to force the drift through the pipe, while the bushings are formed from a softer material so as to avoid injury to the pipe when the drift passes through it. The bushings are formed with channels and holes axially therethrough to allow the passage of fluid contained in the pipe in order that such fluid will not hinder the movement of the drift.

A retriever is also disclosed which may be dropped through the pipe to dislodge a stuck drift. The retriever has a shock transfering end which imparts momentum to the drift in order to free it.

15 Claims, 4 Drawing Figures

FIG. 1
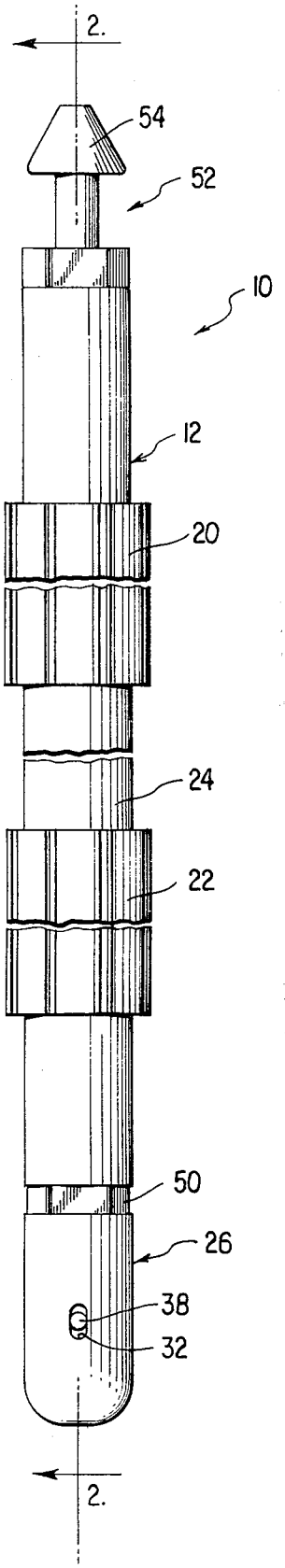
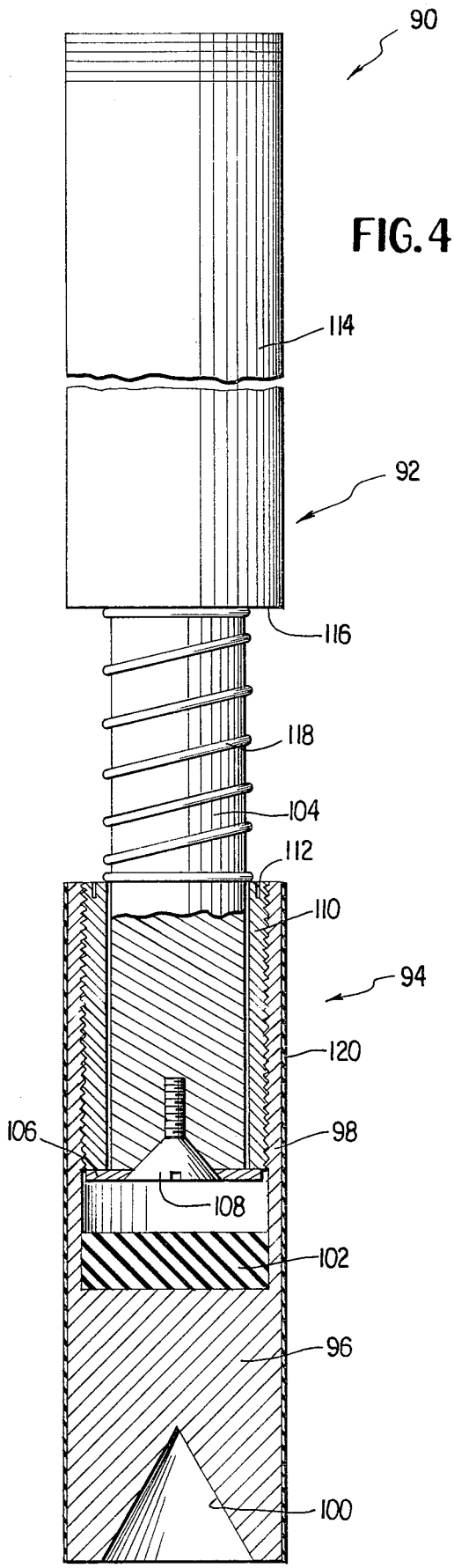
FIG. 4

UNIVERSAL DRIFT AND RETRIEVER

BACKGROUND OF THE INVENTION

1. Field of the Invention

This invention relates to devices for gauging the inside diameter of piping and especially to such devices which are adapted to be dropped or pulled through a pipe.

2. Discussion of Related Art

The oil industry commonly employs various sizes of pipe and casing for the completion of an oil well. Such pipe and casing must be manufactured to exact specifications for the inside diameter. Slight variances of the inside diameter specifications can result in numerous and expensive problems to the company drilling the well.

A common device for gauging the inside diameter of a pipe or casing is referred to as a drift or rabbit. The common drift is a cylindrical shaped element produced from steel, aluminum or nylon. It has a length of approximately 25 inches with an outside diameter formed in accordance with the pipe or casing specifications with which the drift is to be used. The drift is dropped through the pipe or casing. If the drift proceeds through the pipe or casing unimpeded, the pipe or casing is deemed acceptable by industry standards. if the drift progress is impeded by trash, foreign objects or flaws in the pipe, then the pipe is rejected and returned for reworking or cleaning.

Because the standard drift is a solid element, it is necessary that a plurality of drifts be maintained for measuring various sized pipe and casing.

Further, the pipe used in oil field applications is often internally coated with an epoxy resin to improve the life of the pipe and increase the volume of fluid flow therethrough. This coating is relatively delicate and can be damaged easily. Once the coating of a section of pipe has been damaged, that section must be replaced. The removal of a damaged pipe section can be very expensive because several joints of pipe may have to be removed from the bore hole prior to gaining access to the damaged pipe section. The common steel drift can easily damage the coating of a pipe section and, for this reason, its use is not desired.

In order to overcome the potential for damage to the coating of a pipe section, drifts have been produced from softer material such as nylon and aluminum. Nylon and aluminum drifts are built in exactly the same manner as the steel drifts.

One disadvantage of nylon and aluminum drifts is that they are relatively light in weight. Lightweight drifts may become hung up on mud or other nondetrimental foreign substances which do not detract from the quality of the pipe and through which the heavier steel drift could penetrate. This can result in high quality pipe being discarded in error. Additionally, significant time can be lost in attempting to retrieve the drift from the pipe and the drift can be damaged in the process of retrieval.

Also, due to the design of the common drift, difficulties arise during the retrieval process. A retrieval tool must be attached to the drift in order to pull it from the pipe. Once the retrieval tool is attached, the drilling crew still runs the risk of drawing drilling fluid from the pipe as a result of a suction effect.

Further, drifts are often dropped from heights of as much as 85 feet. Consequently, they must be capable of withstanding considerable punishment. Nylon and aluminum drifts are too often incapable of withstanding such punishment are are thus damaged after short periods of use.

There has, therefore, developed a need for a drift which is sufficiently heavy to penetrate nonharmful debris in a pipe being measured yet is incapable of damaging the internal coating of the pipe. The ideal drift should also be universal in nature, that is, be capable of use with pipe having various internal dimensions in order that a large stock of drifts does not need to be maintained on hand. Also, the ideal drift should be capable of withstanding the severe shock developed by being dropped from large heights.

Several devices have been suggested for performing operations on the internal surface of a pipe. However, none of these devices fulfills the requirements of an ideal drift.

U.S. Pat. No. 3,456,727 to Nettles shows a rabbit-type of parafin scraper used to clean off the walls of well tubings. The scraper comprises an elongated metal mandril having a central bore through which fluid passes. A pair of scraping rings are connected about the scraper. The scraper is provided with a nose section constructed from resilient material to cushion the impact of the scraper.

U.S. Pat. No. 3,276,520 to Arnold teaches a plug which includes a fishing head for retrieval, resilient pressure cups and a weight. Arnold also provides fluid bypass holes in the device.

OBJECTS OF THE INVENTION

One object of the present invention is to provide a universal drift which can easily be adapted for use with a variety of pipes having different internal diameters by merely interchanging preformed bushings on the drift.

A further object of the present invention is to provide a universal drift which has sufficient weight to force it through nondetrimental hinderances on a pipe interior, yet is incapable of damaging the relatively delicate coating on a pipe's internal surface.

A further object of the present invention is to provide a universal drift which is capable of withstanding impacts generated by a fall from 85 feet without deforming the drift body.

Another object of the present invention is to provide universal drift which will allow well drilling fluids to pass through it in order to reduce any suction effect created by an attempted retrieval of the drift from an impeded position.

An additional object of the present invention is to provide a universal drift which can be retrieved relatively easily from an impeded position in a pipe being gauged.

Another further object of the present invention is to provide a drift retrieval tool to be used with the drift for forcing the drift past an impediment within a pipe.

SUMMARY OF THE INVENTION

In accordance with the above and further objects, the present invention comprises an elongated body having a shaft portion slidably receiving a first bushing. The first bushing is formed from a relatively soft material and has a cylindrical outer surface for contacting the inner surface of a pipe to be gauged. The diameter of the bushing is substantially greater than the diameter of the body such that the body itself does not touch the inner surface of the pipe.

A second bushing, identical to the first, is also slidably received by the body in axially spaced relation to the first bushing. A cylindrical spacer is disposed between the bushings and also slides relative to the body.

The first bushing abuts a raised shoulder on the rear end of the body, and an end cap is threadably received on the front end of the body and abuts the second bushing to force firm contact to be made between the second bushing, the spacer and the first bushing. A hard rubber element is disposed between the end of the body and the end cap to act as a shock absorber. A pair of holes are formed through the end cap and body. A roll pin is disposed through these holes to lock the end cap in place.

A fishing head in the form of a generally conical element mounted on a shaft is threadedly engaged with the rear end of the body to cooperate with standard oil field retrieval tools to permit removal of the drift from a pipeline when stuck.

An axial opening extends entirely through the body, end cap, hard rubber element and fishing head to allow fluid flow therethrough. Further, a plurality of openings extend axially through each of the bushings in the portion of the bushings which extends radially beyond the body. These openings are also for the purpose of allowing fluid to flow therethrough. This group of openings reduces the suction effect which ordinarily hinders retrieval of a drift.

A retrieval tool is designed to be used with the drift for removing the drift by forcing it through a clog in the pipe. The retrieval tool comprises an anvil portion having a conical indentation to mate with the fishing head of the drift. The anvil portion of the retrieval tool slides on a shaft and is biased forwardly on that shaft by a compression spring which rests against a shoulder formed by an enlarged portion of the other end of the shaft. When the retrieval tool strikes a stuck drift, the shaft moves forwardly against the force of the spring and strikes the anvil portion containing the indentation to send the shock to the drift to dislodge same.

BRIEF DESCRIPTION OF THE DRAWINGS

The above and further objects and advantages of the present invention will become subsequently apparent when the same is further set forth in the Detailed Description of the Preferred Embodiments considered with the accompanying drawings in which like numerals represent like or similar parts throughout and in which:

FIG. 1 is an elevational view of the drift of the present invention;

FIG. 4 is an elevational, part sectional view of the retriever.

DETAILED DESCRIPTION OF THE PREFERRED EMBODIMENTS

Figures 2, 3:
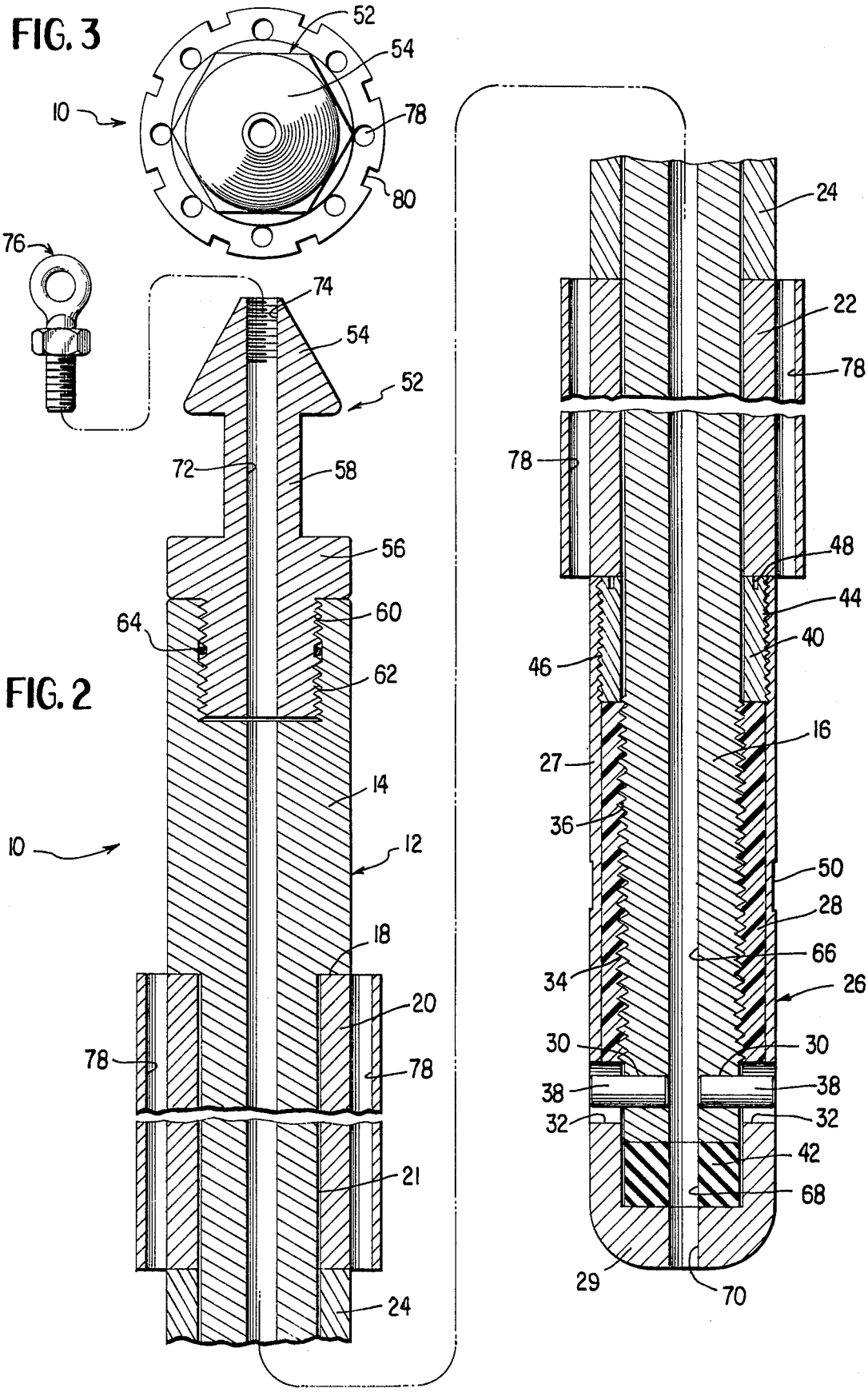
FIG. 2 is an elevational sectional view taken substantially along a plane passing through section line 2—2 of FIG. 1.
FIG. 3 is a top plan view of the drift of the present invention.

Now with reference to the drawings, a drift incorporating the principles and concepts of the present invention and generally referred to by the reference numeral 10 will be described in detail. With specific reference to FIGS. 1–3, it will be seen that the drift 10 comprises a body 12 on which are mounted a pair of bushings 20 and 22 made from relatively soft material. The bushings 20, 22 extend radially outward beyond the body 12 so as to protect the wall of a pipe being gauged from contact with the body 12. The lower portion of the body 12 is attached to an end cap or foot 26 which acts as a shock absorber in a manner to be described hereinafter for absorbing shock received by the drift after it traverses a length of pipe and hits the support upon which the pipe rests. On the opposite end of the body 12, there is attached a fishing head 52 which aids in retrieval of the drift when it has become lodged within a pipe.

The body 12 should be of sufficient length to conform with American Petroleum Institute (API) standards. Thus, it is contemplated that the body 12 will be formed in two lengths, one being $23\frac{3}{8}$ inches and the other being $59\frac{1}{2}$ inches. The material from which the body 12 is to be made should be relatively heavy in order to provide the drift with sufficient momentum to force it through impediments which do not hinder the function of a pipe, for example, mud and other debris. A body having a length of $23\frac{3}{8}$ inches, for example, which is formed from steel, should have a total weight of approximately 25 pounds.

The forward or shaft portion 16 of the body 12 is cylindrical in shape and has a diameter which is sufficiently small to fit within the smallest diameter pipe to be gauged. Shaft 16 may be produced, for example, with a 1 inch diameter. The shaft 16 receives the first bushing 20 which has an internal cylindrical opening 21 through which shaft 16 passes. Bushing 20 slides along shaft 16 until the rear portion of the bushing abuts a shoulder 18 formed on the rear portion 14 of body 12. A spacer 24 is then slid onto shaft 16 to abut the first bushing 20. The second bushing 22, which is preferably identical to bushing 20, also slides onto shaft 16 until it abuts spacer 24. The end cap or foot 26 is then mounted to shaft 16 to hold the bushings 20, 22 and spacer 24 in place.

Bushings 20 and 22 are advantageously formed from a relatively soft material such as aluminum or nylon such that contact of the bushing with the internal pipe surface will not damage the coating normally found on the pipe surface. The bushings 20, 22 are formed with a cylindrical outer surface and have an outside diameter which is slightly less than the internal diameter of the pipe to be gauged. It will be readily understood that a plurality of sets of similar bushings 20, 22 can be made available to accommodate various sizes or weights of pipe or tubing to be gauged. The drift 10 is designed such that end cap or foot 26 can be easily removed to interchange sets of bushings 20, 22 so that one body can be used with any number of sizes and weights of pipe or tubing.

The end cap 26 serves to hold the bushings in place on the body 12 and is mounted to the body 12 in a manner which absorbs the shock of contact of the drift with a surface below the end of the pipe being gauged. The end cap itself includes a shell 27 which is unitary with a base 29. Shell 27 and base 29 are formed from steel and should be sufficiently rugged to accept high impact. The shell 27 has an internal diameter which is sufficiently large to receive a nylon bushing 28 slidably therein. The internal diameter of the shell could be, for example, $1\frac{3}{8}$ inches. Nylon bushing 28 slides inside of the shell and is held firmly against base 29 by an externally threaded cylinder 40. Cylinder 40 has lefthand external threads 44 which mate with internal threads 46 formed on the open end of shell 27. Cylinder 40 is tightened (with end cap 26 removed) by the use of a pin wrench inserted in pin wrench holes 48. This procedure wedges nylon bushing 28 between cylinder 40 and the base 29. Internal threads 36 on bushing 28 engage external threads 34 on shaft 16 to hold the end cap in place. The end cap is tightened or loosened by a suitable wrench which engages wrench grooves 50 formed on the exterior of the end cap. The end cap is locked in place by roll pins 38 inserted through end cap pin holes 32 and base pin holes 30. The end cap pin holes 32 are elongated in an axial direction to allow small axial movements of the end cap relative to the roll pins 38 for a purpose to be discussed hereinafter.

A rubber block 42 is disposed between shaft 16 and base 29 for absorbing shock received by the drift resulting from a drop from a substantial height. End cap 26 is allowed to move relative to body 12 by virtue of the soft nylon bushing 28 which also serves as a mounting for the end cap to the body 12. Also, the bushings 20 and 22 are made from soft material and thus allow limited movement of the end cap 26. Also, as mentioned above, end cap pin holes 32 are elongated in the axial direction so that end cap movement is not restrained by the roll pins 38. The end cap movement transfers the received shock to rubber block 42 which absorbs and dampens the shock thereby reducing the possibility of damage to the body 12.

The rear end of the body 12 is enlarged as compared to the shaft 16. The rear end 14 also contains an opening having internal threads 60 for receiving fishing head 52. Fishing head 52 comprises a substantially conical head 54 connected to a hexagonal fishing head base 56 through a shaft 58. Base 56 contains external threads 62 which mate with threads 60. A nylon lock bushing 64 holds the fishing head in place as would be apparent to one of ordinary skill in the art. The fishing head 52 can be used with standard oil field fishing tools for retrieval of the drift 10. Standard retrieving tools, as is well known to one of ordinary skill in the art, lock onto conical head 54 so that the drift can be pulled back up through a pipe in which it has been dropped in the event that the drift becomes stuck.

In order to allow drilling fluid to pass through the drift 10, an axial passageway is formed therein comprising axially aligned openings 72, 66, 68 and 70 formed in the fishing head 5, body 12, rubber block 42 and end cap base 29, respectively. This passageway reduces the suction effect normally associated with retreival of a drift by standard drilling field retrieval tools. In order to further reduce this suction effect, a plurality of holes 78 are formed in each of the bushings 20 and 22. Holes 78 extend axially of body 12 in the portion of the bushings which extend radially beyond the body. As shown, eight holes 78 are formed in each bushing and are spaced at equal intervals circumferentially thereabout. Also, a plurality of grooves or channels 80 are formed in the outer surface of each bushing and extend axially therealong. Grooves allow even greater fluid flow past the drift 10. As shown, each bushing includes eight grooves 80 which are positioned alternately with holes 78.

An eyelet 76 is provided so that the drift 10 can be attached to a lead and pulled through a pipe to be gauged rather than dropped therethrough. The eyelet 76 can be mounted by connection with threads 74 formed in the finishing head opening 72.

As discussed above, conical head 54 is designed for use with standard well drilling retrieval tools. However, these retrieval tools are somewhat difficult to use and should be employed only if the pipe or casing being gauged cannot be freely moved about, or if the joints between pipe or casing sections cannot easily be accessed. In the event that the drift 10 becomes lodged in a pipe or casing section which is completely accessible, a unique retrieval tool 90 shown in FIG. 4 is preferably employed to dislodge the drift 10.

Retrieval tool 90 contains a hammer section 92 and an anvil section 94. Anvil section 94 is designed to cooperate with conical head 54 of drift 10 while hammer section 92 is designed to impart sufficient force through the anvil to the drift 10 to dislodge the drift from mud or other debris in the pipe or casing being gauged. The retrieval tool 90 is simply dropped through the pipe or casing in which the drift 10 is lodged to attempt removal. In the event that this procedure is not successful, the pipe or casing can be inverted, at which time the retrieval tool 90 can be dropped through the opposite end of the pipe or casing thus impacting the end cap base 29 to force the drift 10 back through the pipe or casing.

Anvil section 94 comprises a head 96 and a casing 98 which are unitary. The head 96 contains a conical indentation 100 which is designed to mate with conical head 54 of fishing head 52. Casing 98 mounts a rubber block 102 which rests against head 96. Casing 98 also receives a shaft 104 of hammer section 92. A plate is secured to the bottom of shaft 104 by a screw 108. Plate 106 extends laterally of shaft 104 and abuts threaded insert 110 to hold shaft 104 within casing 98. Threaded insert 110 contains external threads which mate with internal threads formed on casing 98. Insert 110 can be tightened appropriately by a pin wrench for engaging pin wrench holes 112.

The upper end of hammer section 92 contains a large heavy element 114 which is enlarged compared to shaft 104 to form a shoulder 116. A compression spring 118 is mounted between shoulder 116 and insert 110 to force hammer section 92 upwardly with respect to anvil section 94. This upward movement is limited by plate 106 which abuts the lower edge of insert 110.

In use, when the retrieval tool 90 is dropped through a pipe and strikes the drift 10, indentation 100 engages the drift. Hammer section 92 continues its downward movement while anvil section 94 stops against the drift. The lower end of shaft 104 containing plate 106 strikes rubber pad 102 thus transferring the impact force through the anvil to the drift. The rubber pad cushions the shock generated so that the drift will not be injured.

The retrieval tool 90 should be dimensioned so that the diameter thereof is approximately equal to the body diameter of the drift 10. In this manner, the retrieval tool can be used in pipe or casing of any weight or size.

Also, the outer surface of the entire anvil 94 and the outer surface of element 114 should be coated with a rubber substance as shown at 120 in order to prevent the retrieval tool 90 from damaging the coating on the internal surface of the pipe being gauged.

As is readily apparent, the above describes a unique and useful drift 10 which can be used in a variety of weights and sizes of pipes and casings to be gauged internally. The drift 10 allows for the interchangeability of bushings 20, 22 by simply removing pins 38 whereupon end cap 26 and associated components can be screwed from the shaft 16 leaving bushings 20, 22 and spacer 24 free to slide from the shaft. An appropriate sized set of bushings can then be placed on the shaft and locked in place by the end cap 26 to accommodate the pipe being gauged.

Clearly, additional modifications and variations of the above-described invention should be obvious to one of ordinary skill in the art without departing from the scope of the invention, as set forth in the appended claims.

I claim as my invention:

1. A device for gauging the inside diameter of a pipe, comprising:

an elongated body;

a first bushing slidably received on said elongated body, said bushing being formed of a material substantially softer than the material of the pipe to be gauged, said bushing further having a substantially cylindrical outer surface for contacting the inner surface of the pipe to be gauged;

cap means for removably retaining said bushing on said body; and resilient pad means contained within said cap means for absorbing shock.

2. The invention as defined in claim 1 wherein said body includes a substantially cylindrical outer surface, and said bushing includes a substantially cylindrical inner opening adapted to slide over said outer surface.

3. The invention as defined in claim 2 wherein the diameter of said bushing is substantially greater than the diameter of said body.

4. The invention as defined in claim 1 wherein said body is formed from metal.

5. The invention as defined in claim 1 and further including a fishing head means formed on one end of said body for engaging a retrieving device.

6. The invention as defined in claim 5 wherein said fishing head means comprises a conical element.

7. The invention as defined in claim 1 and further including a second bushing slidably mounted to said body in axially spaced relation to said first bushing.

8. The invention of claim 7, wherein said first and second bushings each include an outer portion that extends radially beyond said body.

9. The invention as defined in claim 8 wherein said first and second bushings each contain a plurality of circumferentially spaced, axially extending holes formed in said outer portions to allow fluid to pass therethrough.

10. The invention as defined in claim 9 and further wherein each of said first and second bushings contain a plurality of circumferentially spaced, axially extending channels formed in the outer surface of said outer portions for allowing fluid to pass therethrough.

11. The invention as defined in claim 1, wherein said first bushing is formed from a synthetic material.

12. A device for gauging the inside diameter of a pipe, comprising:

an elongated body;

a first bushing slidably received on said elongated body, said bushing being formed of a material substantially softer than the material of the pipe to be gauged, said bushing further having a substantially cylindrical outer surface for contacting the inner surface of the pipe to be gauged;

cap means for removably retaining said bushing on said body; and flexible mounting means for mounting said cap to said body.

13. The invention as defined in claim 12, wherein said flexible mounting means includes a nylon bushing disposed between said cap means and said body.

14. The invention as defined in claim 12 and further in combination with a retrieval tool having an anvil adapted to contact said device for gauging, and a hammer slidably attached to said anvil.

15. The invention as defined in claim 14 and further including resilient pad means disposed between said anvil and said hammer for limiting the shock delivered to said device for gauging.

* * * * *